US005404666A

United States Patent [19]

Cline, Jr.

[11] Patent Number: 5,404,666

[45] Date of Patent: Apr. 11, 1995

[54] RAMROD PULLER

[76] Inventor: James B. Cline, Jr., Rte. 1, Box 214-A, Belleville, W. Va. 26133

[21] Appl. No.: 288,199

[22] Filed: Aug. 9, 1994

[51] Int. Cl.[6] ..... F41A 35/00

[52] U.S. Cl. ..... 42/90

[58] Field of Search ..... 15/104.165; 42/90, 95

[56] References Cited

U.S. PATENT DOCUMENTS

| | | | |
|---|---|---|---|
| 877,778 | 1/1908 | Kaufman . | |
| 1,237,056 | 8/1917 | Kitchen . | |
| 1,532,223 | 9/1924 | Belding . | |
| 1,665,988 | 4/1928 | Smith | 15/104.165 |
| 2,779,042 | 1/1957 | Benny | 15/104.09 |
| 3,814,525 | 6/1974 | Spencer . | |
| 4,843,747 | 7/1989 | Echeberria | 42/90 |
| 5,075,998 | 12/1991 | Selleck . | |
| 5,092,072 | 3/1992 | Fritts | 42/90 |
| 5,233,778 | 8/1993 | Pink, Sr. | 42/95 |

*Primary Examiner*—Charles T. Jordan
*Assistant Examiner*—Theresa M. Wesson
*Attorney, Agent, or Firm*—Browdy and Neimark

[57] ABSTRACT

A device that facilitates the pulling out of any of a variety of ramrods which becomes stuck in a gun barrel is of a cylindrical configuration with a circular cross-section and includes a cylindrical handle, having a radial hole extending entirely therethrough at about its middle and two axial bores extending from its two respective ends, and two bolt-like elements screwable into the axial bores and/or into a ramrod which in combination function to grip or clamp an end of the ramrod to the cylindrical handle.

11 Claims, 2 Drawing Sheets

RAMROD PULLER

FIELD OF THE INVENTION

This invention relates to a manual device for pulling out a ramrod from a muzzle-loading rifle.

BACKGROUND OF THE INVENTION

Old-time guns such as muzzle loading rifles have become popular among some gun collectors and others, including history devotees. A gun such as a muzzle loader requires a ramrod to load the gun with ball and powder as well as to clean the gun barrel. Not infrequently, the ramrod becomes stuck in the gun barrel with only about two inches of the ramrod normally protruding out from the muzzle, making it difficult for the user to grasp the ramrod to pull it out. Several tools are commonly used to pull out a stuck ramrod. There are different types of ramrods currently being used for muzzle loaders; some have threaded bores at one or both ends, e.g 8–32 and 10–32 threaded ends, and some do not. The threaded bores are used to attach accessories such as a cloth covered cleaning tips.

One tool is a pair of vise-grip pliers and a rag that can be used to clamp down on the tip section of the ramrod protruding out from the gun muzzle and then to pull the ramrod out with vise-grip pliers while the gun is firmly secured in a vise or is being firmly held by another person. The rag is placed between the jaws of the vise-grip pliers and the ramrod to prevent the jaws of the pliers from marring or damaging the ramrod.

A variation on the use of vise-grip pliers is to place the tip section of the ramrod in a vise secured to a heavy stationary object such as a workbench, being careful not to mar or otherwise damage the ramrod, and pulling on the gun to dislodge the ramrod.

Another tool is a commercially available ramrod puller made of brass and having two handles, each with a leather lined jaw at one end. The two handles are pivotally connected so that as the opposing leather lined jaws of the ramrod puller securely grasp the tip section of the ramrod by pulling the handles in a direction away from the gun, the ramrod can be pulled out of the gun barrel with two hands if the gun itself is securely held by another person or fastened to a fixed object.

The above tools must all be used with care to prevent marring or damage to the ramrod. Furthermore, these tools normally require a two-person operation or a one-person operation with at least a stationary vise to be successful. Consequently, a person out alone in the field would experience great difficulty in removing a ramrod stuck in the barrel of a muzzle loader.

SUMMARY OF THE INVENTION

It is, accordingly, an object of the present invention to overcome deficiencies in the prior art, such as noted above.

Another object of the invention is to provide a ramrod puller that can be universally used to manually pull out various types of ramrods from rifle muzzles.

Still another object of the invention is to provide a ramrod puller that can be stored in a compact manner and can be easily carried.

A further object of the invention is to provide a ramrod puller so that, in the field, a single individual can pull out a ramrod that has become stuck in a rifle muzzle.

The invention relates to a device that facilitates the pulling out of a ramrod, particularly ramrods for rifle muzzles. The present ramrod puller is a multi-purpose ramrod puller capable of being securely fastened onto the tip section of a ramrod either by engaging the threaded bore on the end of a ramrod or by clamping onto the ramrod tip section itself in such a way that prevents marring or damage to the ramrod.

The ramrod puller is of a cylindrical configuration with a circular cross-section and includes a cylindrical handle, having a radial hole extending entirely therethrough at about the middle thereof and two axial bores extending from its two respective ends, and two bolt-like elements screwable into the axial bores and/or into a ramrod which in combination function to grip or clamp an end of the ramrod to the cylindrical handle. This ramrod pulling device or puller is compact and can be conveniently carried in the field. It can also be used with any of the various types of available ramrods. For ramrods with threaded bores at one or both ends, a bolt-like element of the ramrod puller is capable of extending through the central radial hole and screwing into a corresponding threaded axial bore on the end of the ramrod. All the necessary pieces of the ramrod puller are stored together and can be easily assembled in various ways in order to accommodate and pull out the different ramrod types.

BRIEF DESCRIPTION OF THE DRAWINGS

The above and other objects and the nature and advantages of the present invention will become more apparent from the following detailed description of an embodiment of the invention, taken in conjunction with the drawing, wherein.

Figure 1:
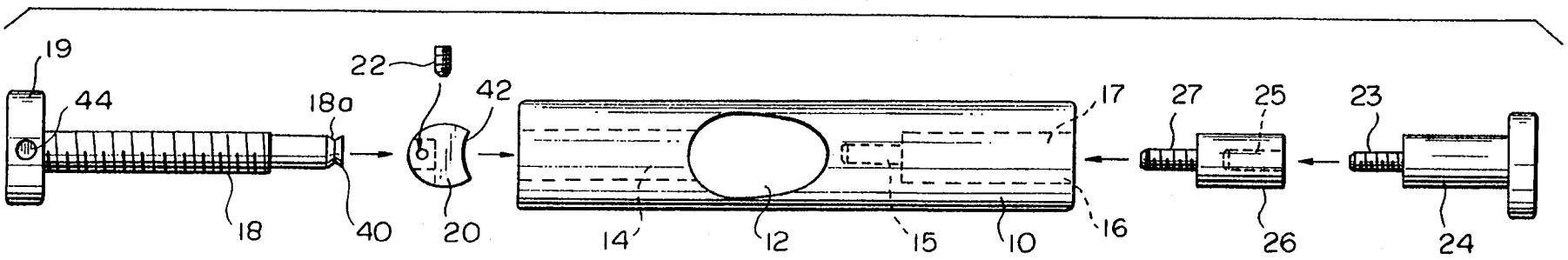
FIG. 1 is an exploded view of a ramrod puller of the present invention in its stored configuration.

FIGS. *3a–3c* are plan views showing the three ways of using the ramrod puller of FIG. 1 with different types of ramrods.

DETAILED DESCRIPTION OF THE INVENTION

The invention relates to a multi-purpose ramrod puller device which is capable of facilitating the pulling out of any type of ramrod used with muzzle loaders. This multi-purpose ramrod puller can be easily carried in its stored cylindrical configuration where all its component elements are joined together to fit inside a cylindrical handle.

All the elements of the preferred embodiment of the ramrod puller are shown in FIG. 1 as an exploded view of the ramrod puller in its stored configuration. A cylindrical handle 10 has a radial hole 12, preferably egg-shaped in the axial direction as illustrated, extending entirely therethrough at about the middle thereof and two axial bores 14 and 16 extending from its two respective ends as represented by the dashed lines. One axial bore 14 is threaded and communicates with radial hole 12. The other axial bore 16 has a threaded section 15 and a non-threaded section 17, the threaded section 15 having a smaller diameter than the non-threaded section 17.

Figure 2:
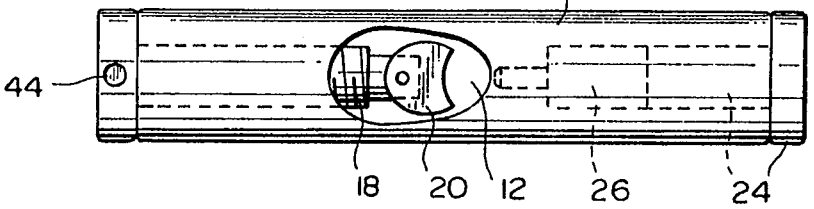
FIG. 2 is an assembled view of a ramrod puller of FIG. 1 in its stored configuration.

A bolt-like threaded element 18, having a first end with a head 19 and a free end 18*a*, is inserted into and attached to a chuck 20 at such free end 18*a* by engagement of set screw 22 with groove 40 at the free end 18*a* and is threaded into axial bore 14 in both the stored configuration and the operating positions of the ramrod puller. At the other end of the cylindrical handle 10, a headed bolt-like cheater bar 24 having a threaded end 23 is screwed into the correspondingly threaded end 25 of a cheater bar adaptor 26. Cheater bar adaptor 26, which has a threaded end 27 opposite the end 25 that is engaged with the bolt-like cheater bar 24, is screwed into the threaded section 15 of axial bore 16 for storage. FIG. 2 shows the preferred embodiment of the ramrod puller in its compact stored configuration.

When the ramrod puller is needed for pulling a stuck ramrod from the barrel or muzzle of a rifle, the cheater bar 24 and its adaptor 26 can be unscrewed and removed from its storage position in cylindrical handle 10. If the ramrod is of the type which has a threaded ramrod end, then either the cheater bar 24 or the cheater bar 24 attached together with its adaptor 26 can be screwed into the threaded ramrod end, the choice being dependent on the size of the threaded recess present in the ramrod end. Preferably, cheater bar 24 has 8–32 threads and cheater bar adaptor 26 has 10–32 threads. Thus, cheater bar 24 can be used alone for a ramrod having an 8–32 threaded end recess whereas cheater bar 24 and its adaptor 26 can be used together as an extended cheater bar for a ramrod having a 10–32 threaded end recess.

Figure 3C:
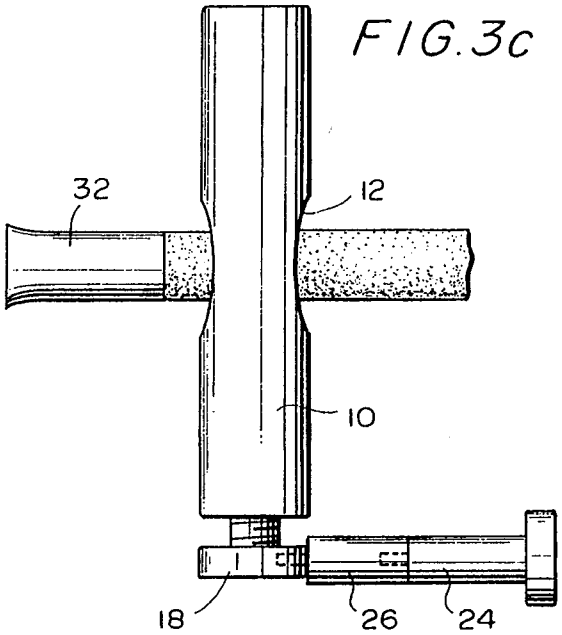
Figure 3B:
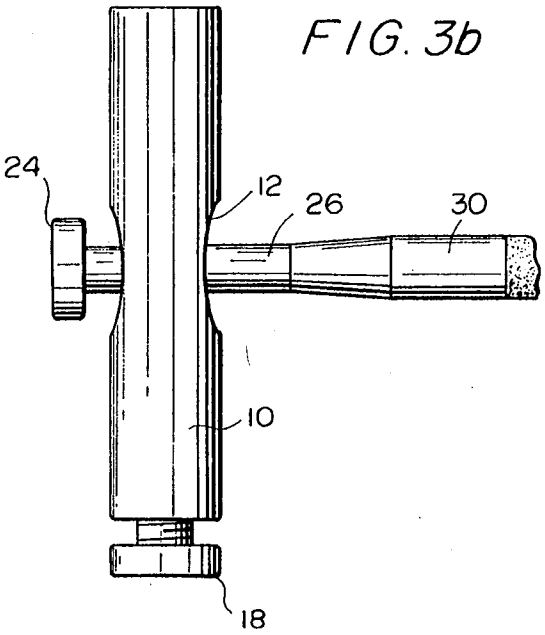
Figure 3A:
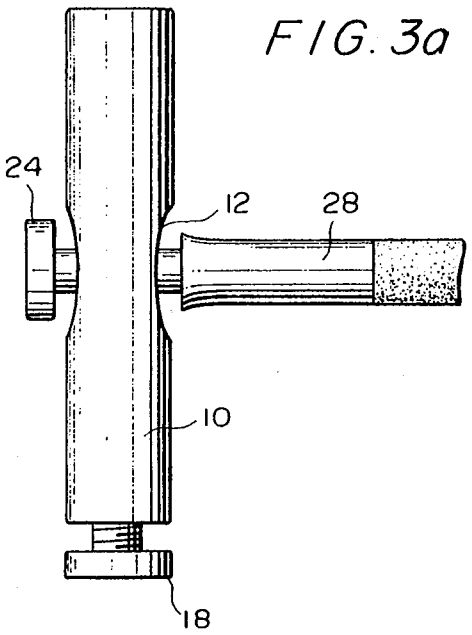

Cylindrical handle 10 is clamped onto the cheater bar 24 or the extended cheater bar (cheater bar 24 together with adaptor 26) as illustrated in FIG. 3*a* and FIG. 3*b*, respectively, either before or after the ramrod is engaged with the cheater bar or its extended version. The cheater bar or its extended cheater bar version is first extended through the radial hole 12 and is then screwed into the end 28 or 30 of the ramrod. The bolt-like threaded element 18 attached to chuck 20 can be screwed into threaded axial bore 14 to urge chuck 20 (FIGS. 1 and 2) into firm engagement with the cheater bar or its extended cheater bar version for clamping.

As shown in FIG. 1, it is preferred that when the bolt-like threaded element 18 is screwed further into or out of axial bore 14, set screw 22 engages groove 40 at the end 18*a* to secure the chuck 20 to the bolt-like threaded element 18, but not so firmly such that chuck 20 will rotate with the screwing action of bolt-like threaded element 18. Rather, it is preferred that chuck 20 can be urged into engagement with a cylindrical cheater bar or ramrod extending through radial hole 12 by maintaining itself in a position to engage its curved face 42 with the corresponding curved surface of the cheater bar or ramrod. Set screw 22 may be tightened further once chuck 20 firmly clamps the cheater bar or ramrod against the narrow end of the radial hole 12 of the handle 10.

For ramrods lacking a threaded end or for ramrods having a threaded end incompatible with the cheater bar 24 or its adaptor 26, the elements of the multi-purpose ramrod puller can be combined as illustrated in FIG. 3C. The extended cheater bar (24 and 26) can be screwed into a corresponding threaded hole 44 on the side of the head portion 19 of bolt-like threaded element 18 (see FIGS. 1 and 2) to facilitate tightening of bolt-like threaded element 18 and attached chuck 20 for clamping by providing better leverage. However, the cheater bar 24 or its extended version need not be used at all for ramrods lacking a threaded end or having an incompatible threaded end; they can be kept stored in cylindrical handle 10 while bolt-like element 18 and chuck 20 clamp the ramrod. In other words, the multi-purpose ramrod puller can be used in essentially its storage configuration for ramrods lacking a threaded end or having an incompatible threaded end, or even those having compatible threaded ends. The invention is versatile not only with regard to the variety of ramrods it can be used for, but also in number of ways it can be used.

Preferably, the multi-purpose ramrod puller is made of metal, most preferably brass. However, it is intended that the multi-purpose ramrod puller can be made from any suitably rigid and durable material such as wood or even certain types of rigid and structurally strong plastics.

The multi-purpose ramrod puller advantageously provides versatility in the types of ramrods on which it can be used. The invention also solves an existing problem with common ramrod pulling tools currently in use; that is, a ramrod puller can now be easily and conveniently carried into the field where a single individual can use this ramrod puller in a one-man operation to pull out a ramrod stuck in a gun barrel. Once clamped to a ramrod to form a T-shaped handle, the ramrod puller can be grasped and pulled with one hand while holding the gun with the other hand. Alternatively, the user can simply place the T-shaped handle, formed by the ramrod puller and the ramrod itself, down in the fork of a tree and then backing up while holding or pulling the gun to free the stuck ramrod.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A ramrod puller comprising:

a cylindrical member having a radial hole extending entirely therethrough at about the middle thereof, and a first threaded axial bore extending from a first end along a longitudinal axis of said cylindrical member, said first threaded axial bore communicating with said radial hole, said cylindrical member serving as a handle for pulling out a ramrod;

a bolt-like threaded element having a headed end and a free end and being threadingly engagable in said first threaded axial bore; and a chuck attached to said free end of said bolt-like threaded element, said chuck being capable of firmly clamping to said cylindrical member a ramrod extending through said radial hole.

2. A ramrod puller as recited in claim 1, further comprising a means for engaging a threaded ramrod end, said means for engaging a threaded ramrod end comprising a bolt-like element having a headed end, a threaded end and a rod-like cylindrical body, said threaded end being capable of threadingly engaging a correspondingly threaded ramrod end and said rod-like cylindrical body capable of being firmly clamped by said chuck and, wherein said cylindrical member has a second partially threaded axial bore extending along said longitudinal axis of said cylindrical member from a second end opposite said first end and capable of being threadingly engaged with said means for engaging a threaded ramrod end.

3. A ramrod puller as recited in claim 2, wherein said means for engaging a threaded ramrod end further comprises an adaptor having a threaded free end and an open end, said open end having a correspondingly threaded axial bore for being threadingly engaged to said threaded end of said bolt-like element, said threaded free end of said adaptor being capable of threadingly engaging a correspondingly threaded ramrod end.

4. A ramrod puller as recited in claim 3, wherein said second axial bore being partially threaded with corresponding threads for storing said means for engaging a threaded ramrod end by threadingly engaging said threaded free end of said adaptor.

5. A ramrod puller as recited in claim 3, wherein said headed end of said bolt-like threaded element has a threaded radial bore, said threaded free end of said adaptor being capable of threadingly engaging said threaded radial bore of said headed end of said bolt-like threaded element for facilitating the tightening of said chuck against a ramrod.

6. A ramrod puller as recited in claim 2, wherein said threaded end of said means for engaging a threaded ramrod end is an 8–32 threaded end.

7. A ramrod puller as recited in claim 3, wherein said threaded free end of said adaptor is a 10–32 threaded end.

8. A ramrod puller comprising:

a cylindrical member having a radial hole extending entirely therethrough at about the middle thereof and a partially threaded axial bore extending from one end along a longitudinal axis of said cylindrical member, said cylindrical member serving as a handle for pulling out a ramrod; and a means for engaging a threaded ramrod end being capable of threadingly engaging said partially threaded axial bore for storage.

9. A ramrod puller as recited in claim 8, wherein said means for engaging a threaded ramrod end comprises:

a bolt-like element having a headed end, a threaded end and a rod-like cylindrical body, said threaded end being capable of threadingly engaging a correspondingly threaded ramrod end; and an adaptor having a threaded free and an open end, said open end having a correspondingly threaded axial bore for being threadingly engaged to said threaded end of said bolt-like element, said threaded free end of said adaptor being capable of threadingly engaging a correspondingly threaded ramrod end.

10. A ramrod puller as recited in claim 9, wherein said threaded end of said means for engaging a threaded ramrod end is an 8–32 threaded end.

11. A ramrod puller as recited in claim 9, wherein said threaded free end of said adaptor is a 10–32 threaded end.

* * * * *